US007353962B2

(12) United States Patent
Parnall et al.

(10) Patent No.: US 7,353,962 B2
(45) Date of Patent: Apr. 8, 2008

(54) BULK SHIPPING CONTAINER HAVING ADJUSTABLE HEIGHT, COLLAPSIBLE WALLS

(76) Inventors: John Parnall, 13146 Midlothian Turnpike, #222, Midlothian, VA (US) 23113; Susan Melanie Shoop, 13146 Midlothian Turnpike, #222, Midlothian, VA (US) 23113

( * ) Notice: Subject to any disclaimer, the term of this patent is extended or adjusted under 35 U.S.C. 154(b) by 716 days.

(21) Appl. No.: 10/838,453

(22) Filed: May 4, 2004

(65) Prior Publication Data
US 2004/0222222 A1 Nov. 11, 2004

Related U.S. Application Data

(60) Provisional application No. 60/467,779, filed on May 5, 2003, provisional application No. 60/528,392, filed on Dec. 11, 2003.

(51) Int. Cl.
*B65D 6/12* (2006.01)

(52) U.S. Cl. ..... 220/6; 220/8

(58) Field of Classification Search ..... 220/4.28, 220/4.31, 6, 7, 8
See application file for complete search history.

(56) References Cited

U.S. PATENT DOCUMENTS

| | | | | |
|---|---|---|---|---|
| 4,674,647 | A | 6/1987 | Gyenge et al. | |
| 5,114,037 | A | 5/1992 | Hillis et al. | |
| 5,289,935 | A | 3/1994 | Hillis et al. | |
| 5,865,334 | A * | 2/1999 | Ruiz et al. | 220/6 |
| 6,601,724 | B1 | 8/2003 | Koefelda et al. | |

* cited by examiner

*Primary Examiner*—Anthony D. Stashick
*Assistant Examiner*—Harry A Grosso
(74) *Attorney, Agent, or Firm*—Thomas & Raring, P.C.

(57) ABSTRACT

A collapsible container has adjustable height walls. The container includes a base defining the bottom wall of the container, an opposing pair of side walls, and an opposing pair of end walls. The side walls and end walls are pivotable between an upright position and a collapsed position over the base. The side walls and end walls each further include extension walls movably connected thereto between a nested, unextended position and an upright, extended position.

4 Claims, 13 Drawing Sheets

BULK SHIPPING CONTAINER HAVING ADJUSTABLE HEIGHT, COLLAPSIBLE WALLS

This application claims the benefit of filing of U.S. Provisional Patent Application Ser. No. 60/467,779, filed May 5, 2003; and U.S. Provisional Patent Application Ser. No. 60/528,392, filed Dec. 11, 2003. Those applications are explicitly incorporated herein by reference as is set forth in their entirety.

The present invention relates to a bulk shipping container having adjustable height, collapsible walls. The present shipping container improves space efficiency and keeps fragile food products safe during shipping and warehousing processes.

BACKGROUND

Bulk shipping containers are well-known and have been manufactured and used in many different sizes and configurations. The containers are adapted for use with a broad range of products being transported and stored. Preferably, the containers are reusable in order to reduce shipping costs and to reduce the unnecessary creation of waste. In order to economically reuse a shipping container, many of the containers are collapsible so that they occupy less space for return shipment after each time that they have been used.

The drawback with current containers is their limited size. In other words, they are only a single size. Therefore, it can sometimes be difficult to use a container for many different products that may need to be shipped. Also, the use of a container may be inefficient if the products do not fit well into the arbitrary space available. While some extension products are known, they are typically difficult to install and may not be efficiently collapsible. Accordingly, there is a need to vary the bulk container wall height in order to efficiently accommodate unit size packages. Also, a variable height container wall may reduce damage to fragile fruit and vegetable products that are not able to be stacked as high as other products in a shipping container.

SUMMARY

Accordingly it is an object of the present invention to overcome the foregoing drawbacks and to provide a container having adjustable height walls.

In one example, a collapsible container having adjustable height walls comprises a base defining the bottom wall of the container, an opposing pair of side walls and an opposing pair of end walls. The side walls and end walls comprise first hinges that pivotally connect the side walls and end walls to the base. The side walls and end walls are pivotable between an upright position and a collapsed position over the base. The side walls and end walls further comprise first latches to releasably engage respective adjacent pairs of side edges of the side walls and end walls when the side walls and end walls are in their upright position. The side walls and end walls each further comprise extension walls moveably connected thereto between a nested, unextended position and an upright, extended position. The extension walls further comprise second latches to releasably engage respective adjacent pairs of side edges of the extension walls when the extension walls are in their upright, extended position.

The collapsible container may have extension walls that further comprise second hinges that pivotally connect the extension walls to their respective side walls and end walls on the opposite side edges of the side walls and end walls from the side edges that connect to the base. The extension walls are pivotable between the nested, unextended position and the upright, extended position.

In another example, the collapsible container may have side walls and end walls that comprise a cavity in a slot along substantially the entire length of the side edge of the side walls and end walls opposite the side edge of the side walls and end walls that connect to the base. The extension walls are adapted to nest within the respective side wall and end wall cavities when in the unextended position and telescope out of the cavities when in the extended position. The end walls and side walls may further comprise a lock for releasably fixing the respective extension walls to each side wall and end wall. The extension walls may be releasably fixed at a plurality of heights.

In another example, a collapsible container has extension walls that are slidably mounted adjacent to each respective side wall and end wall to allow movement of the extension walls from the nested, unextended position to the upright, extended position. When the side walls and end walls are in the unextended position, the extension walls may be mounted on the outside of the container or on the inside of the container.

DETAILED DESCRIPTION

Figure 5:
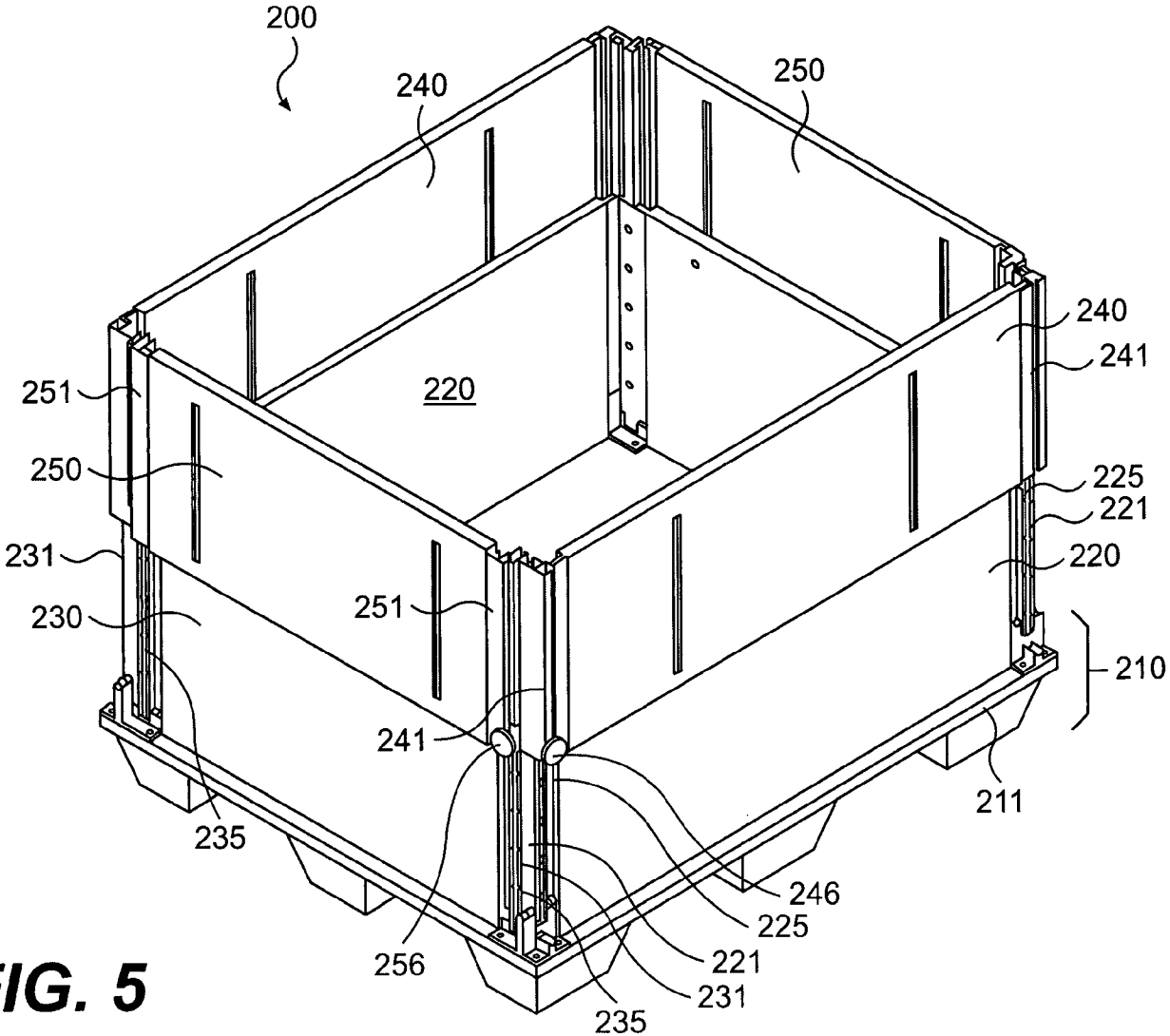
FIG. 5 is a perspective view of a collapsible, extendable container in accordance with a third example described herein.
Figure 6:
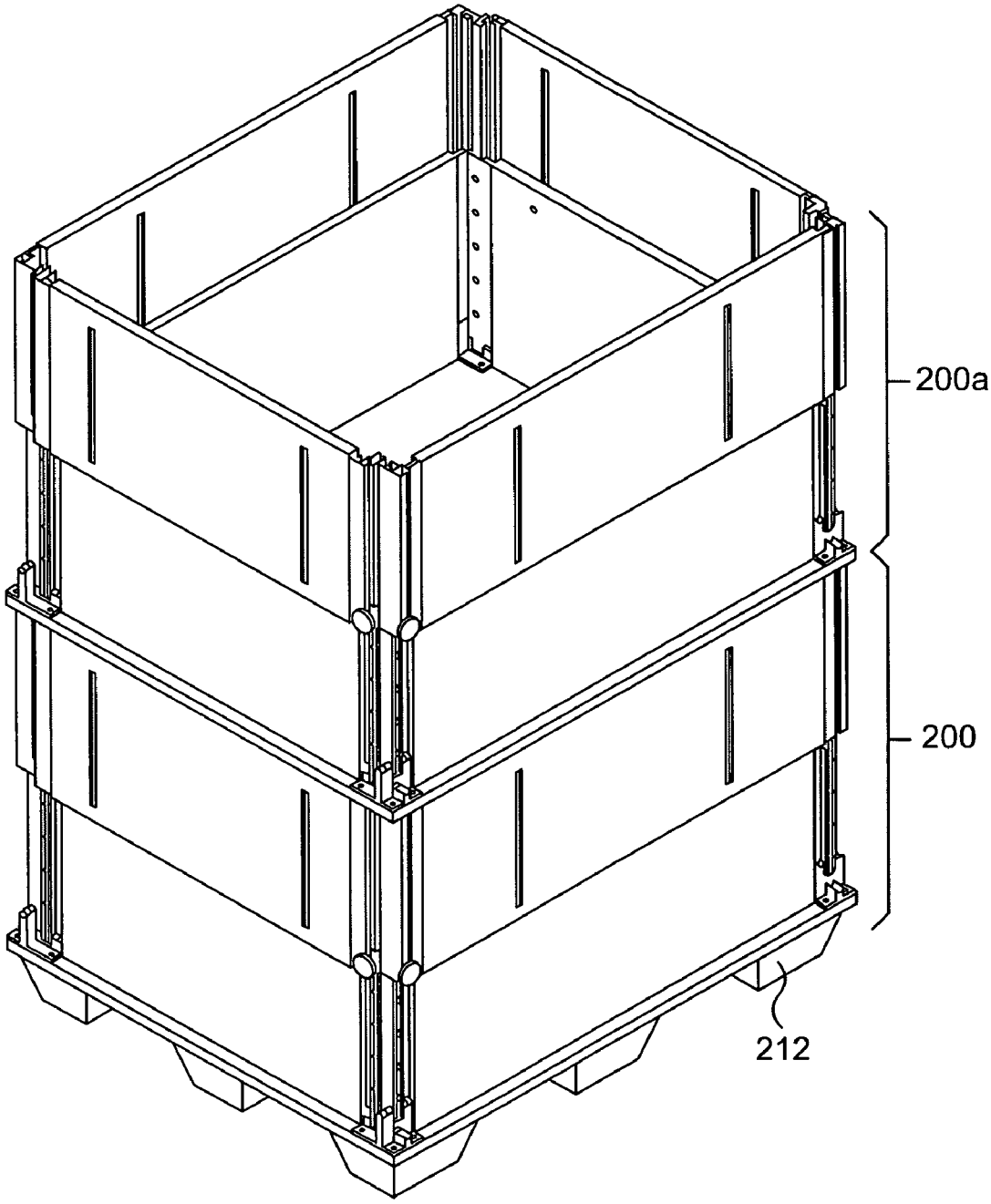
FIG. 6 is a perspective view of a pair of containers shown in FIG. 5 in a stacked relationship.
Figure 7:
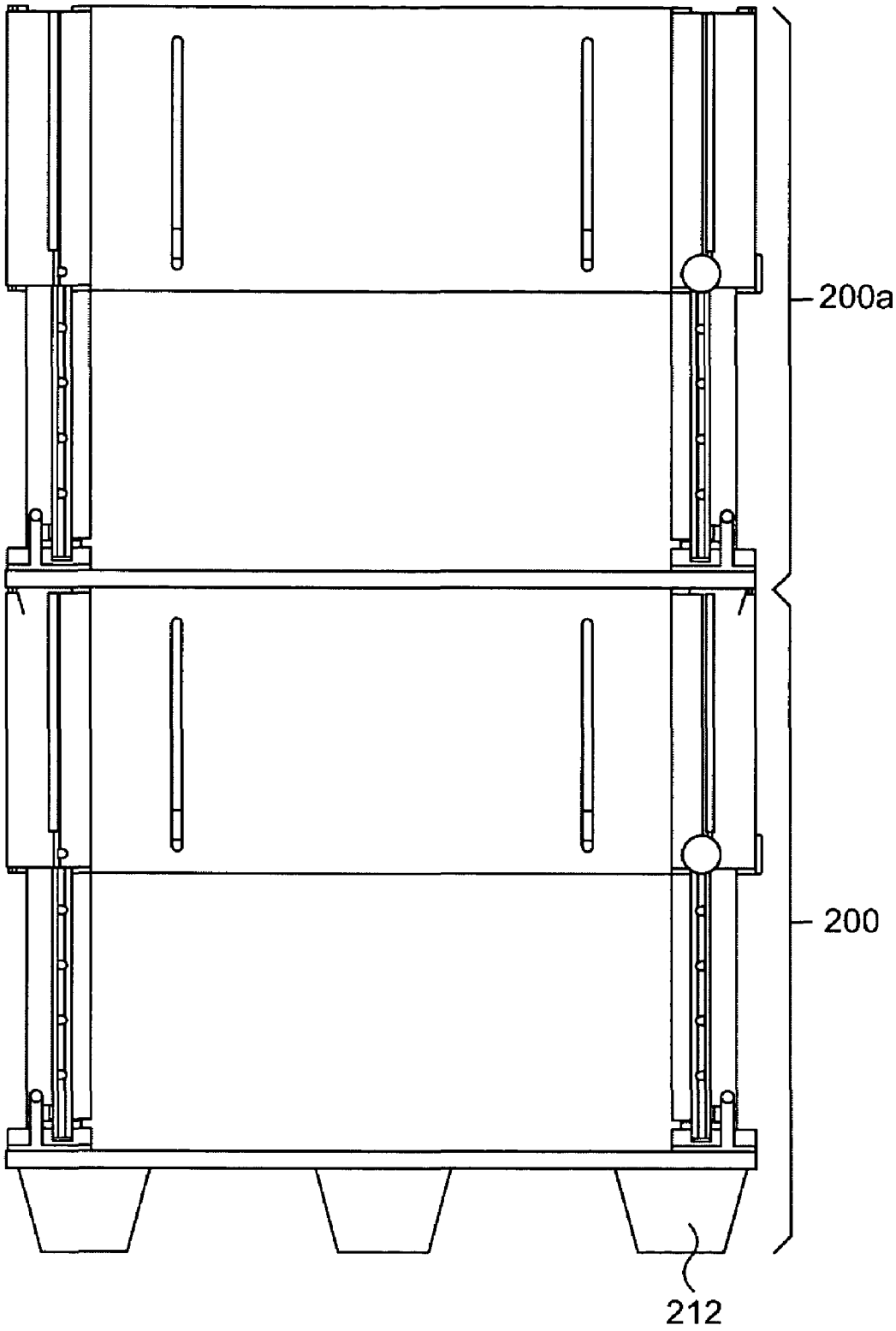
FIG. 7 is a side elevation view of the container shown in FIG. 5 in the stacked relationship.

The present invention is directed to a bulk shipping container having adjustable height side walls. At least several different embodiments of this type of shipping container are discussed herein. The different examples may be characterized generally as a folding concept (FIGS. 1A-1D and 2), a multi-height, telescoping extension concept (FIGS. 3A-3D and 4), and a multi-height, sliding extension concept (FIGS. 5-7). In some examples, the basic components include a base with collapsible, vertical walls. A difference from prior containers, however, is that the walls further include extension walls that may be used to increase the height of the container walls and thereby increase the volume the container may hold.

Figure 1A:
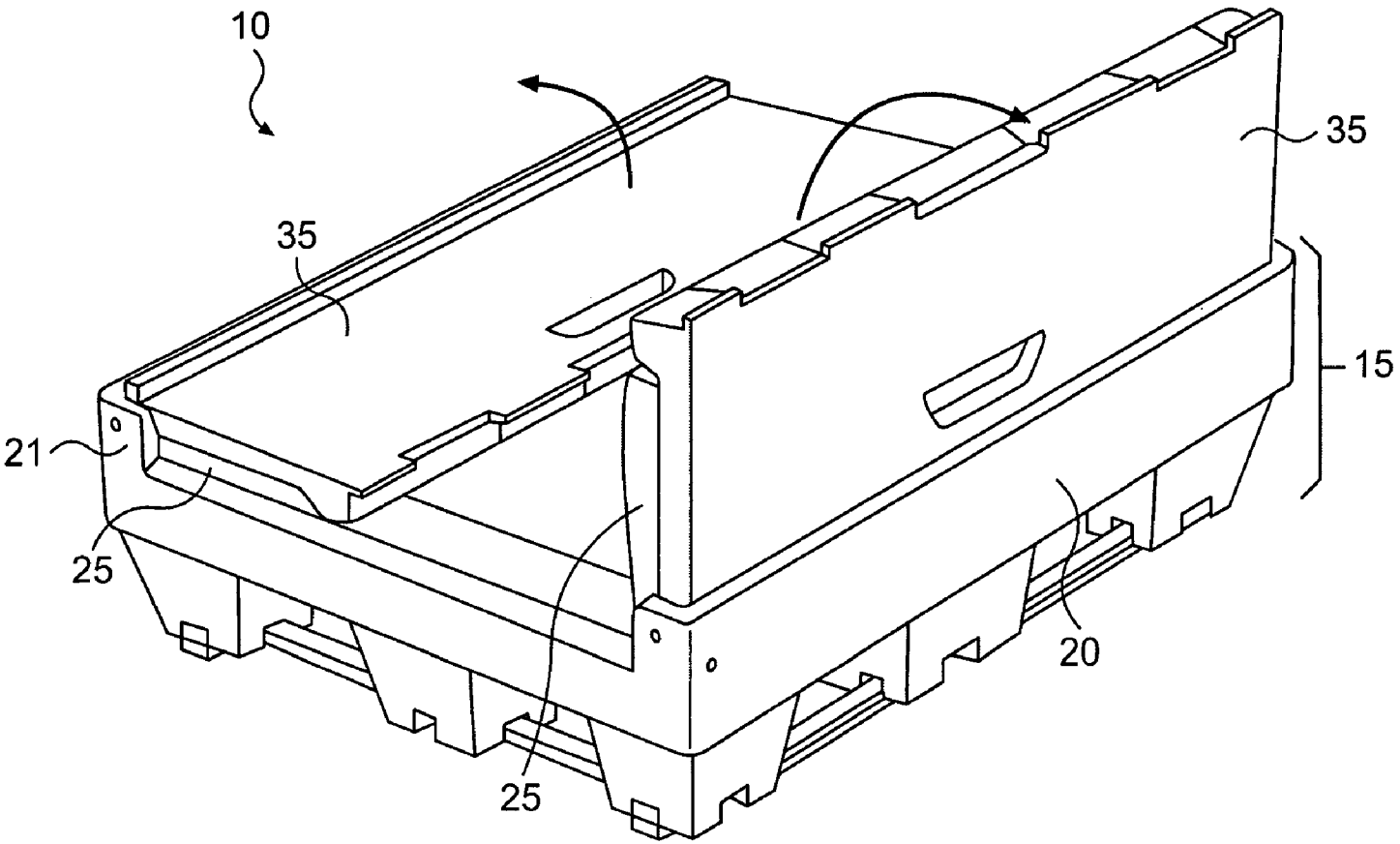
FIGS. 1A-1D are perspective views of the assembly of a collapsible, extendable container in accordance with one example described herein.
Figure 1B:
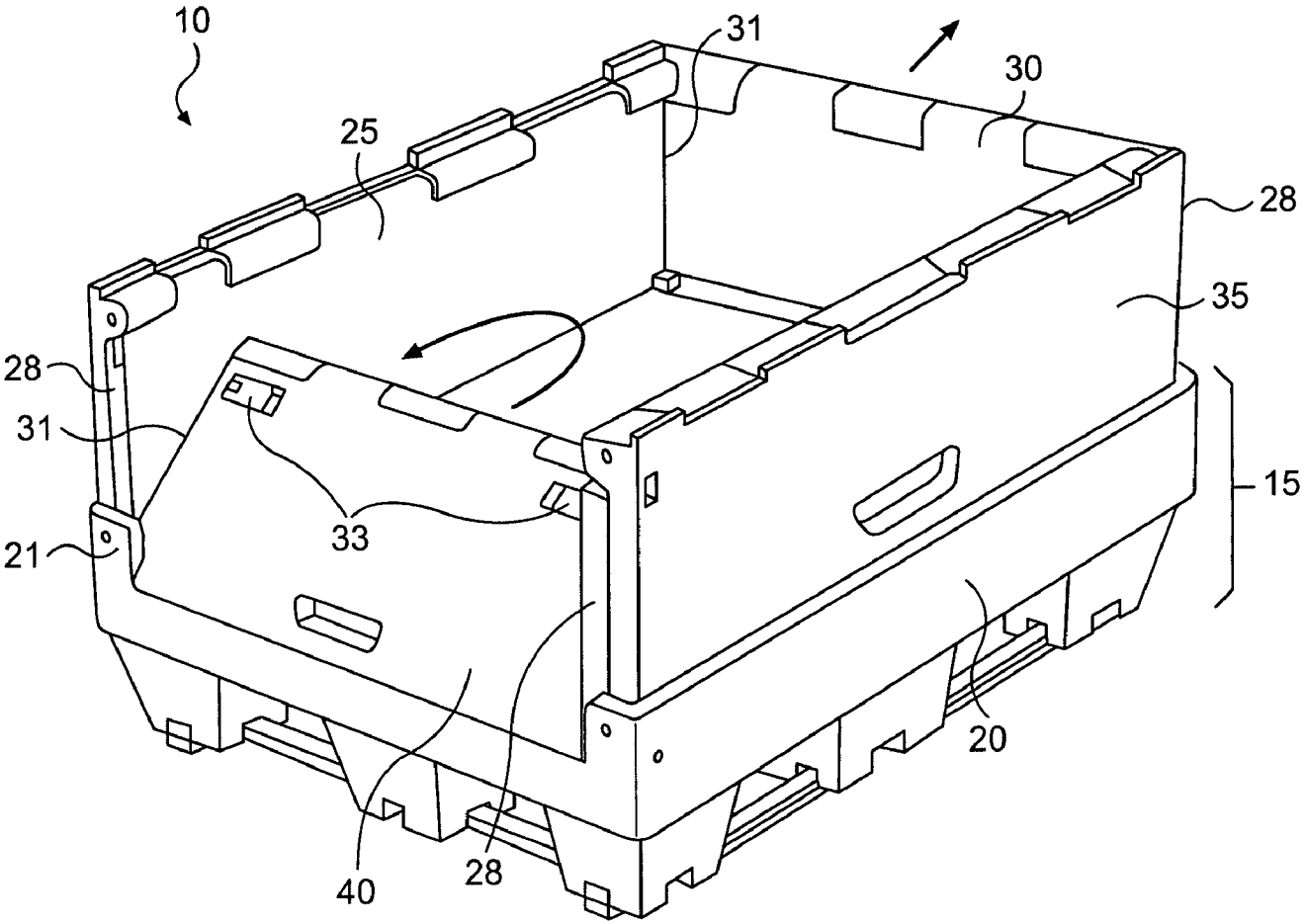
Figure 1C:
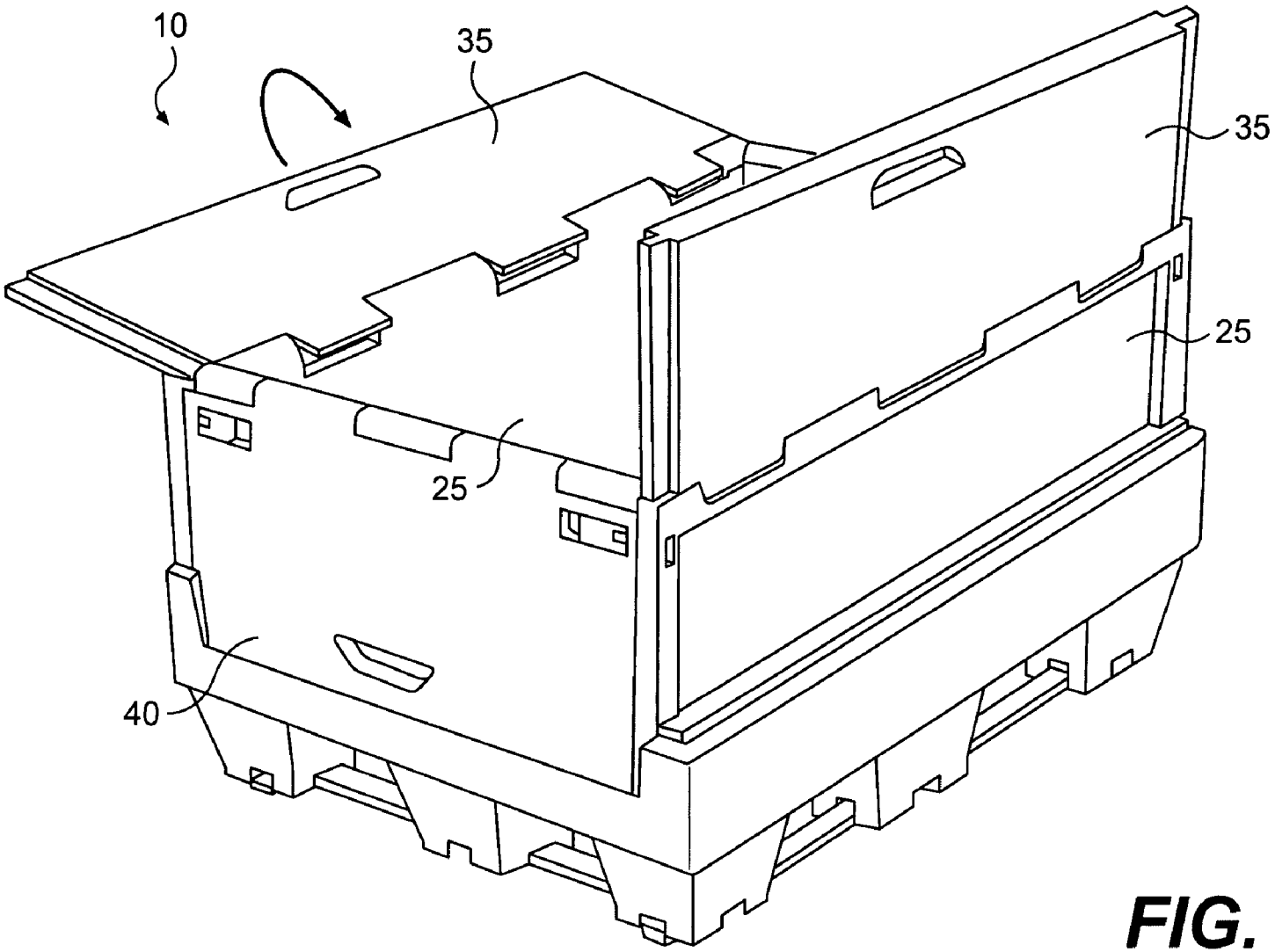
Figure 1D:
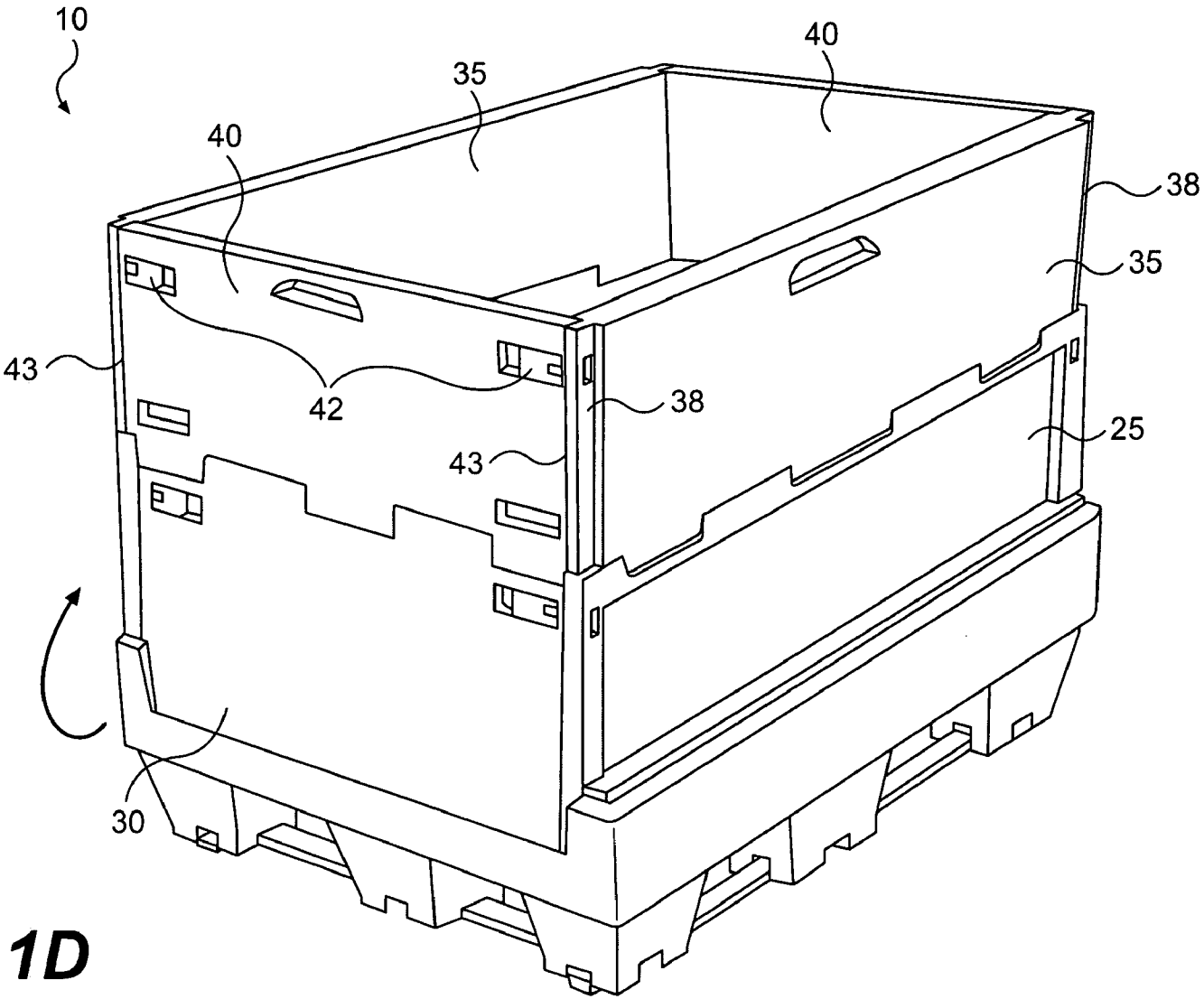
Figure 2:
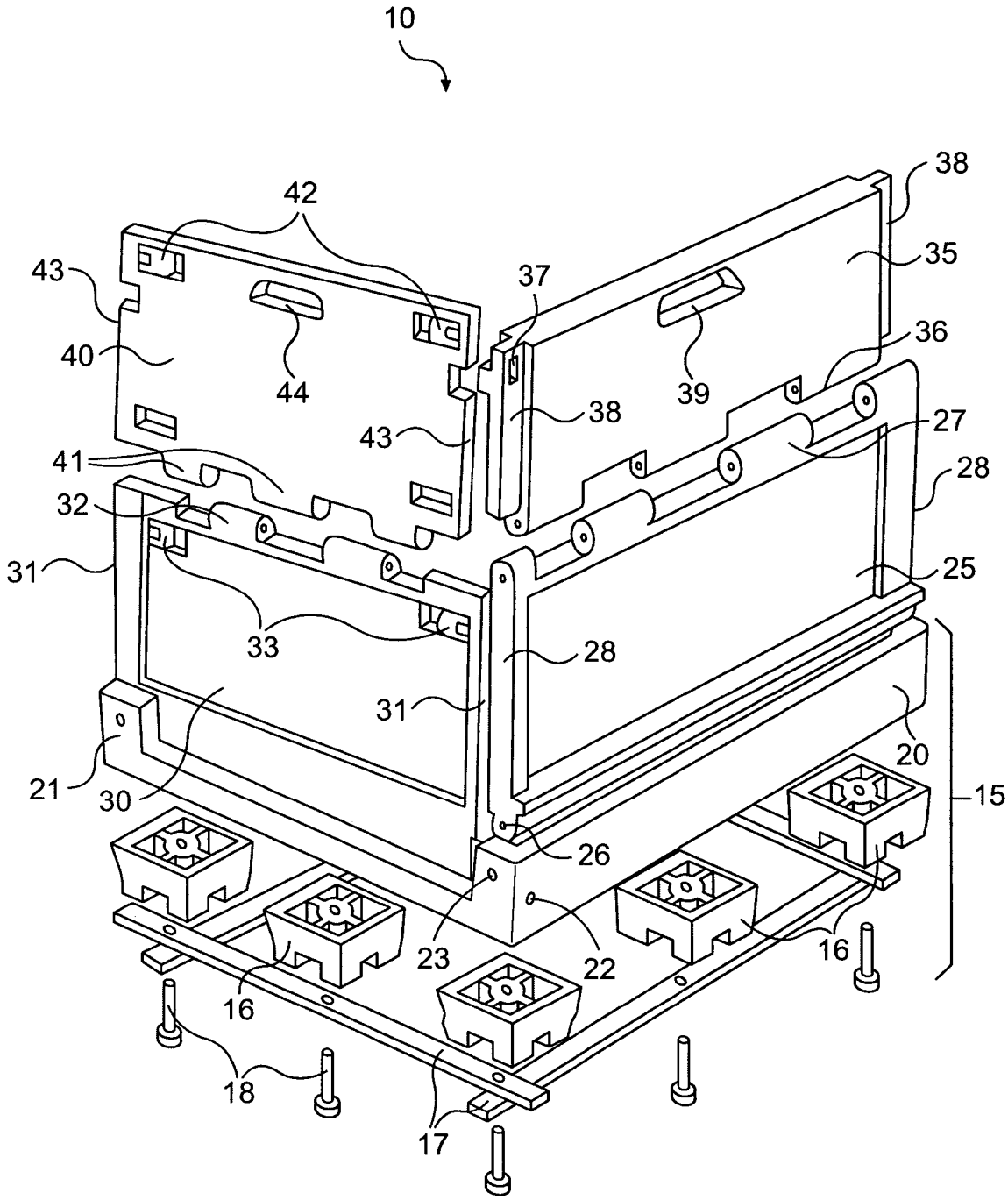
FIG. 2 is an exploded, perspective view of a portion of the collapsible, extendable container shown in FIGS. 1A-1D.

Turning first to FIGS. 1A-1D and FIG. 2, there is illustrated a collapsible container having folding extension walls. FIG. 2 is an exploded view of the container (only two walls shown). The other side wall and end wall not shown mirror those that are. FIGS. 1A-1D illustrate how the container may be transformed from the fully collapsed position to the fully extended position.

The base 15 is the portion of the container 10 that defines the bottom wall, base or floor of the container. A base like base 15 is generally conventional. Most container base constructions that are known and accepted in the industry would be useable in connection with a container that is otherwise described herein. The base 15 includes replaceable foot portions 16 that are connected together by struts 17 or forkstraps and bolts 18. The base wall 20 is, in one example, formed of twin sheets of thermoformed plastic, injection molded structural foam, or injection molded plastic. The base wall 20 includes a raised ridge 21 on opposite sides of the base wall. The base wall 20 further includes apertures 22 and 23 that received hinge rods (not shown) that connect the base 20 to the side walls 25 and end walls 30.

The vertical walls of the container 10 are referred to herein as side walls 25 and end walls 30. As shown, the side walls 25 are longer than the end walls 30, but the container may be any acceptable dimension. There is no limitation implied in the nomenclature of the side walls 25 and end walls 30. On the bottom side edge of the side walls 25 is a hinge connection 26 in which is received a hinge rod that also extends through aperture 23 in the ridge 21 of the base 15. Likewise, a hinge rod connects the bottom of the end walls 30 in a pivotable fashion to the base ridge walls 21. The walls 25 and 30 are pivotable between collapsed and upright positions. FIG. 1A shows one of the side walls and both end walls in the collapsed position over the base wall 20. Likewise, FIG. 1B shows the side walls 25 and the end walls 30 in the upright position. The side walls 25 and end walls 30 lay flat, because the side walls and end walls do not overlap each other, and the side walls are offset slightly over the end walls as a result of the base ridge walls 21. Latches 33 releasably engage adjacent pairs of side edges 28 and 31 of side walls 25 and end walls 30 respectively. The latches 33 are shown as being integral in the end wall 30 and engaging the side wall 25. Similar latches could be mounted likewise on the side walls 25 to engage the end walls 30. Still further, there could be latches on both the side walls 25 and end walls 30 that engage the respective adjacent walls in order to increase the integrity of the container. In the illustrated example, there is only one latch 33 in each corner so that a user may open a wall with only two hands. The adjacent side edges 28 and 31 of the side walls 25 and 30 may also include an interlocking mechanism. Also shown in the figures, the side walls 25 and end walls 30 have recesses that are adapted to receive at least a portion of the extension walls 35 and 40 respectively while in the nested, unextended position (e.g. FIG. 1B).

Extension walls 35 and 40 are hingedly connected to side walls 25 and end walls 30 respectively. The extension walls 35 and 40 are substantially the same width as the side walls 25 and end walls 30. They are hingedly connected along one edge 41 to the top edge 32 of the end walls and bottom edge 36 to the top edge 27 of the side walls 25. Additional latches 42 are used to secure the end wall extensions 40 the side walls extension 35. Although not shown, the adjacent side edges 38 of the side wall extensions 35 may interlock with the adjacent side edges 43 of the end wall extensions 40. For ease of handling, the extension walls 35 and 40 also include handle apertures 39 and 44 respectively.

The various hinge and latch systems identified herein and illustrated in the drawings are merely exemplary constructions. Those of skill in the art will be familiar with multiple types of systems, and the selection of the particular latch or hinge construction may be made on a case-by-case basis.

Referring now to FIGS. 1A-1D, there is seen the process of converting the container 10 from the fully collapsed position to the fully extended position. In FIG. 1A, the side wall 25 (including extension wall 35) is rotated to the upright position. The accompanying side wall 25 is shown in the nested, collapsed position. In FIG. 1B, the end walls 30 (including end wall extensions 40) are rotated from their collapsed, nested position upwardly into the upright position as shown by the arrows. The latches 33 lock the side walls 25 and end walls 30 into their upright position. In FIG. 1C, the side wall extensions 35 are rotated upwardly into an upright position. In FIG. 1D, the end extension walls 40 are rotated upwardly into the upright position and latched into place via latches 42 to the side extension walls 35. The container 10 may be easily collapsed by merely reversing the steps described herein.

Also, although not shown, it is readily apparent that the side walls 25 and end walls 30 may include additional extension walls (not shown) that would similarly rotate upwardly to form additional height extensions of the container 10. The additional extension walls would nest in generally the same manner as the extension walls 35 and 40 as shown, and would likewise latch together in a similar fashion.

Further, as shown, the extension walls 35 and 40 pivot to the outside of their respective side walls 25 and end walls 30. However, extension walls may also be engineered to instead pivot to the inside of their respective side walls and end walls. This alternative, inside-pivoting construction would function in a similar fashion to that shown in the figures.

Figure 3A:
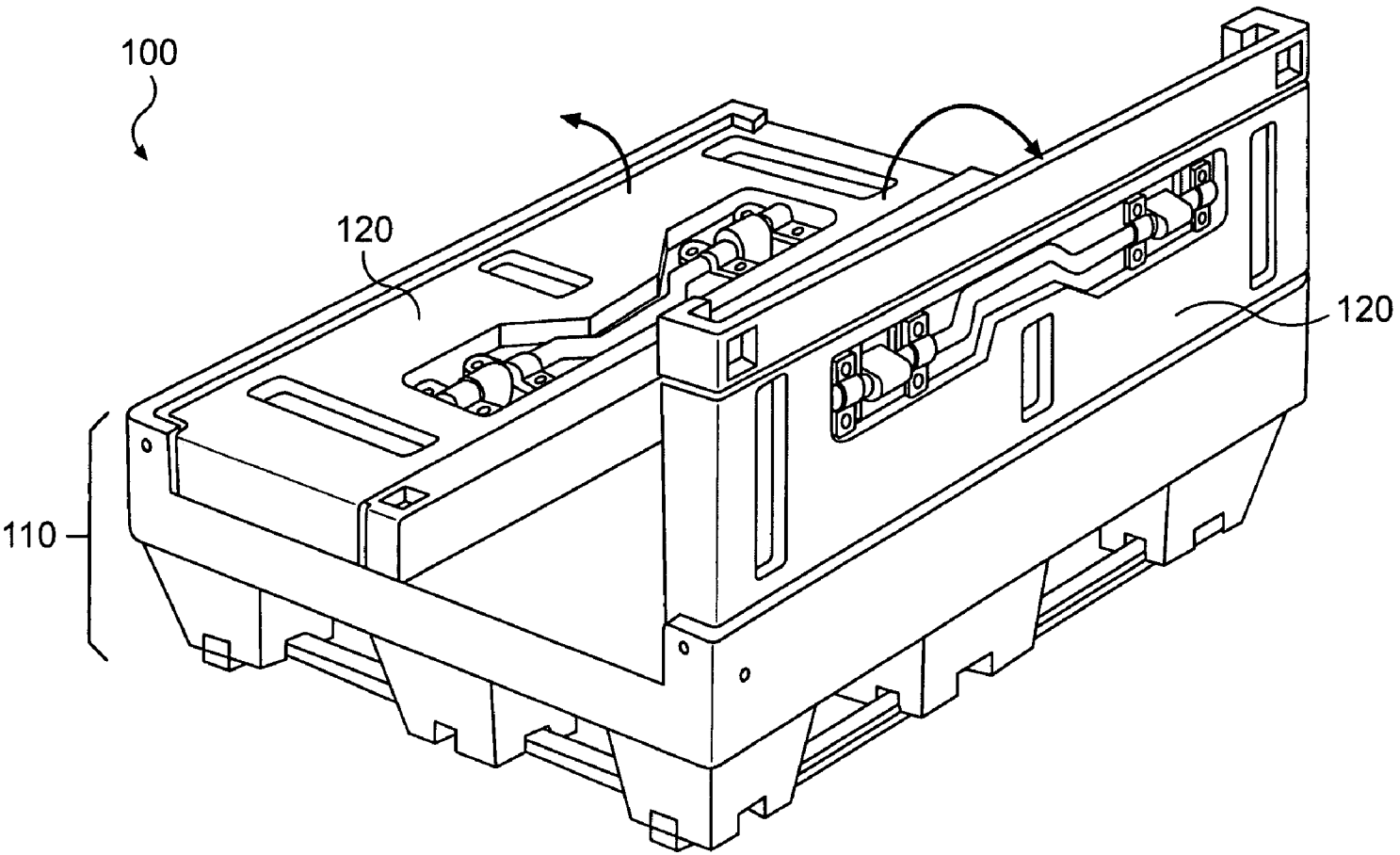
FIGS. 3A-3D are perspective views of the assembly of a collapsible, extendable container as described in an example herein.
Figure 3B:
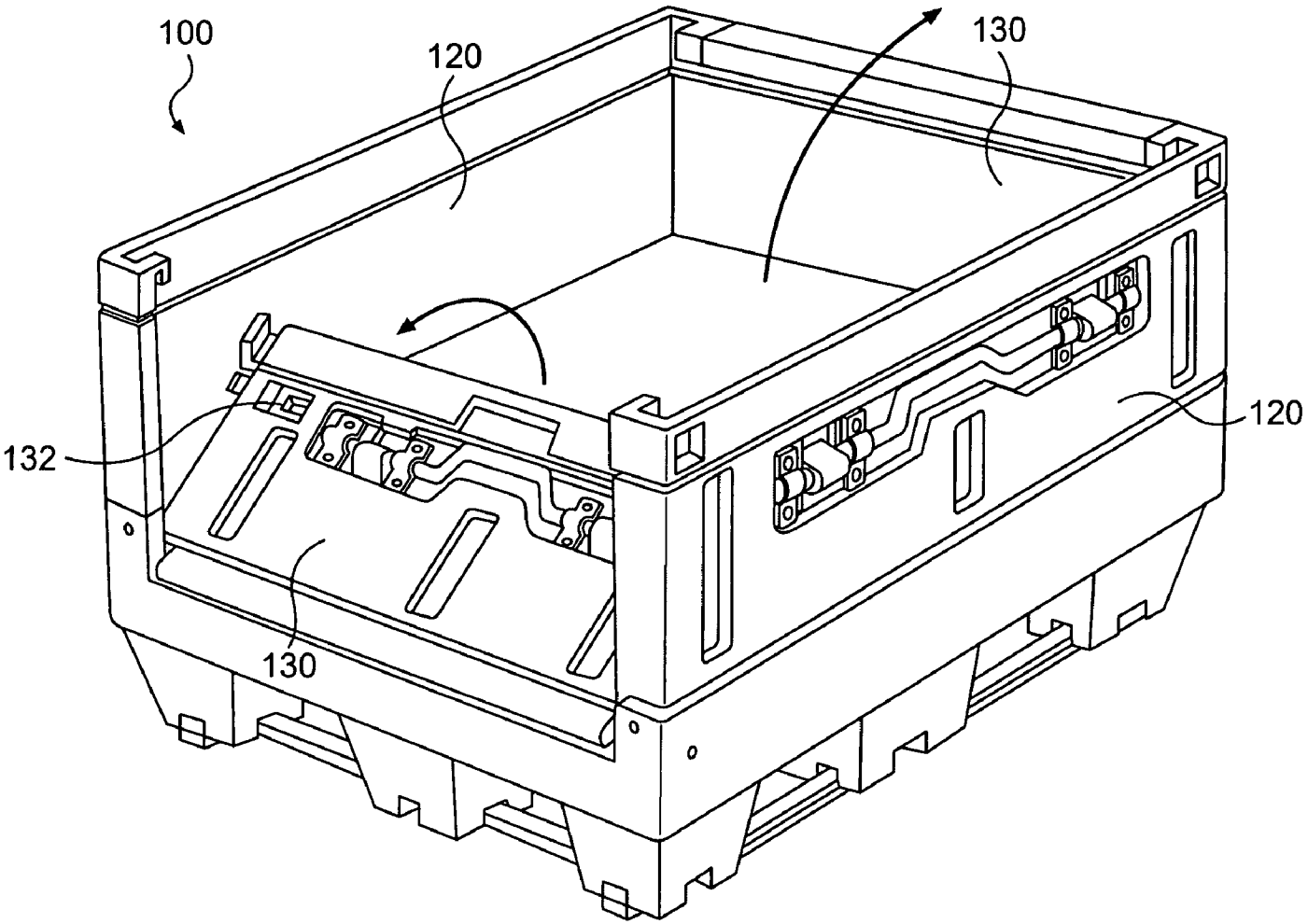
Figure 3C:
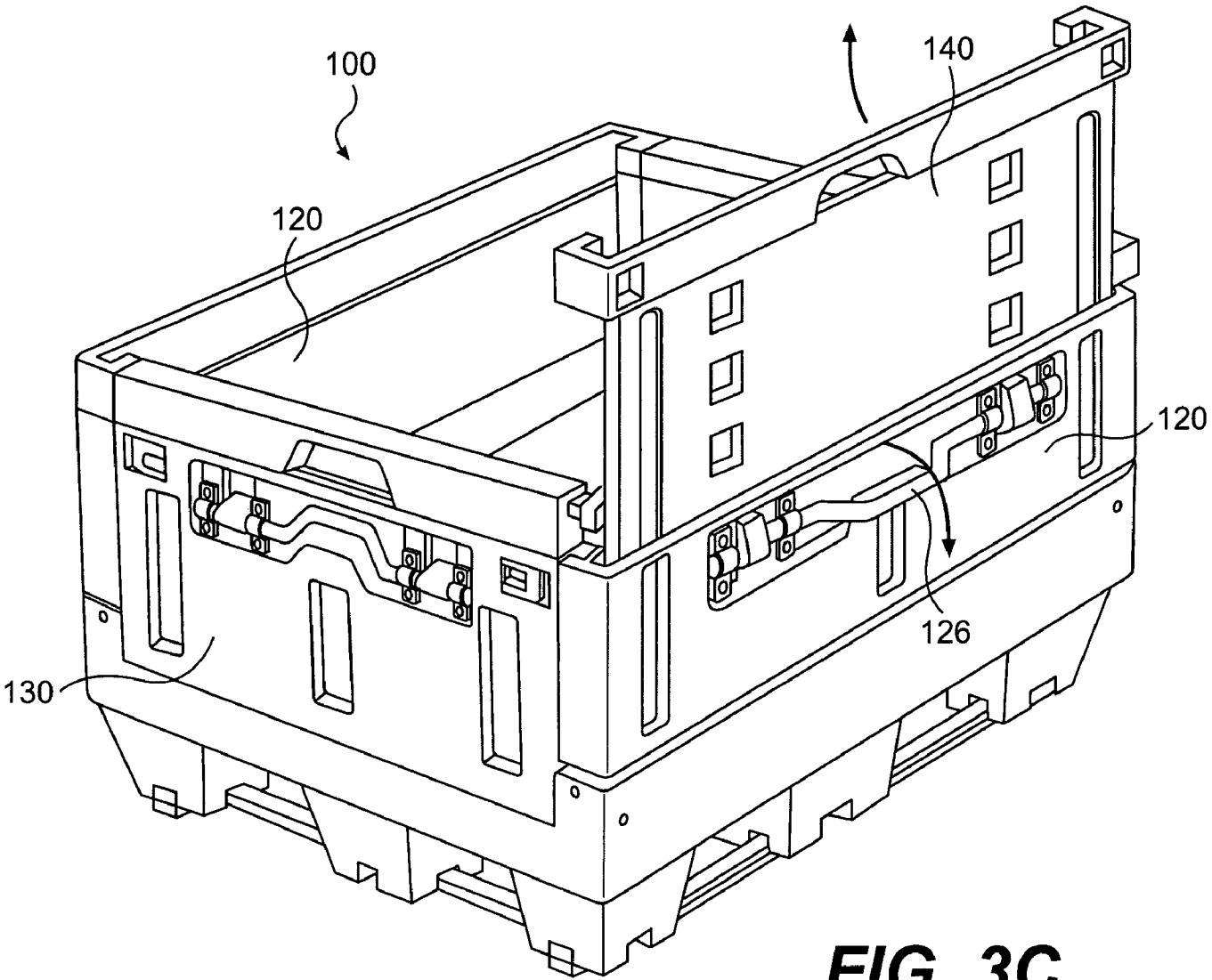
Figure 3D:
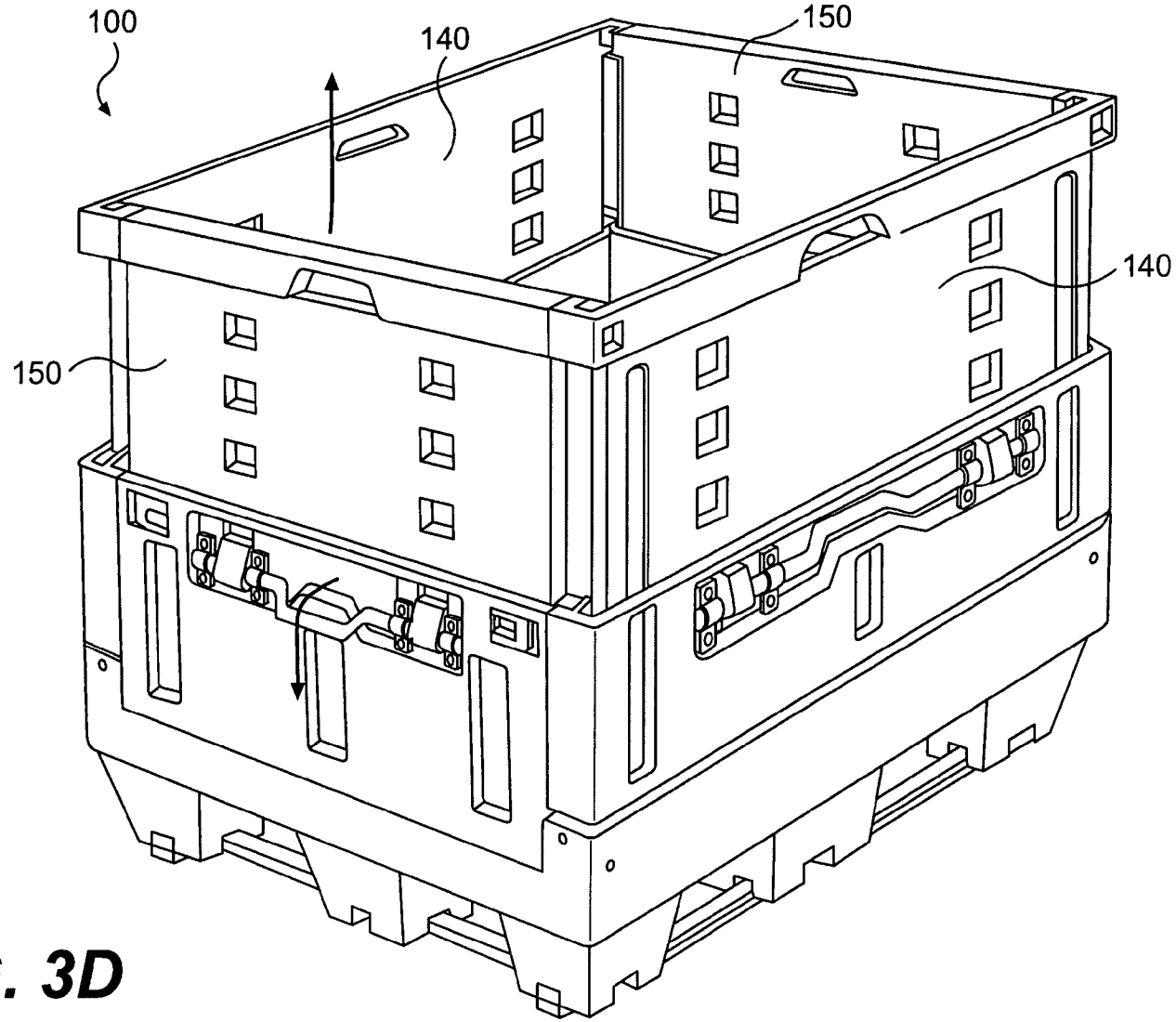
Figure 4:
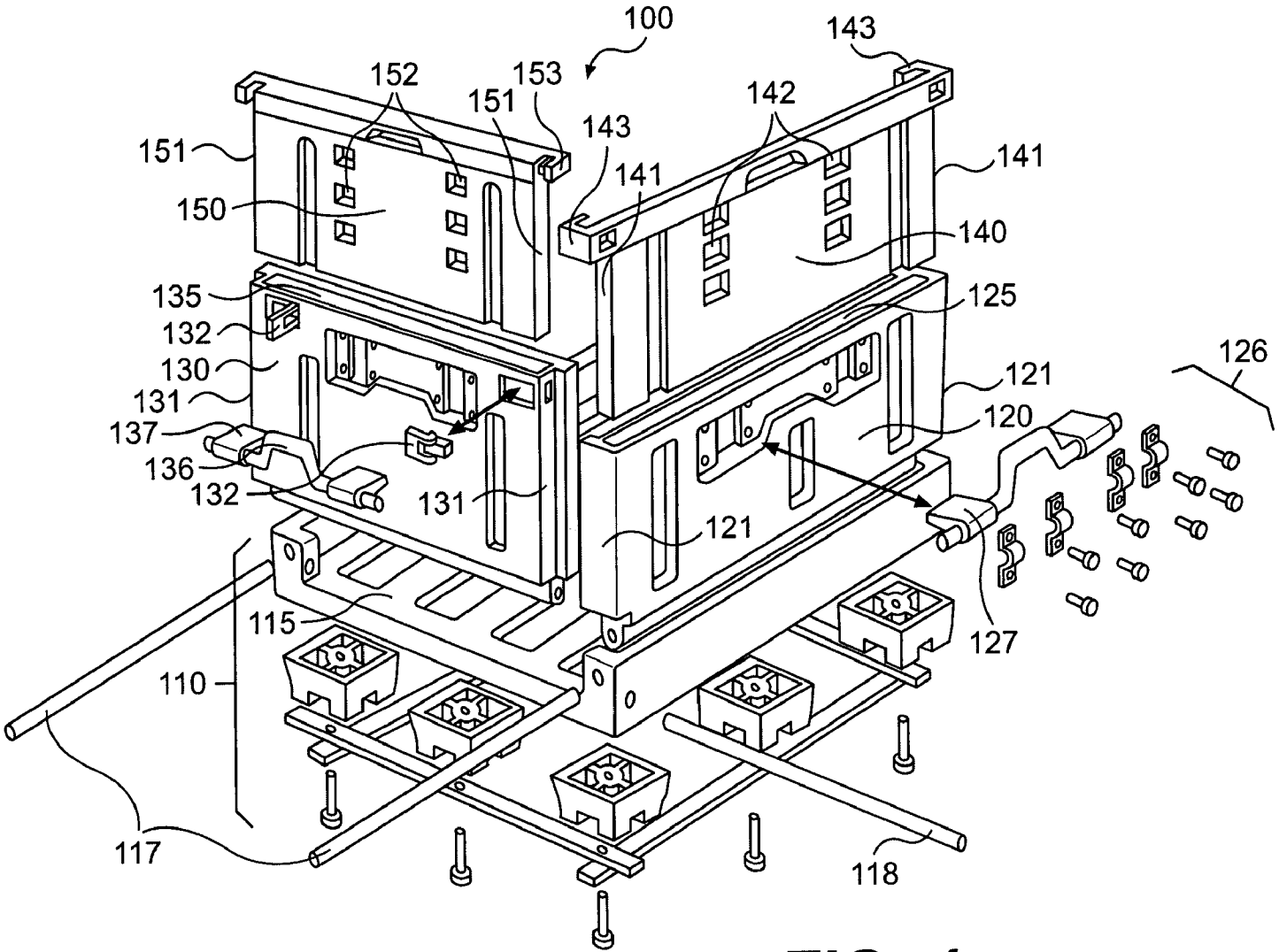
FIG. 4 is a perspective, exploded view of a portion of the container shown in FIGS. 3A-3D.

FIGS. 3A-3D and 4 illustrate the multi-height, telescoping extension concept of the container described herein. Turning first to FIG. 4, there is shown a container 100 in an exploded view. Only two walls are shown, but the companion side wall and end wall not shown are merely the mirror image of the side wall 120 and end wall 130 that are shown. The base 110 of the container 100 is identical to the base 15 shown in FIG. 2. FIG. 4 further shows the hinge rods 117 and 118 that interact with the base wall 115 and the side walls 120 and end walls 130 to create the pivotable relationship. This is the same pivoting construction as shown in connection with the container 10 in FIGS. 1A-1B and FIG. 2. The side walls 120 and end walls 130 are secured by latches 132 in the upright position where the side edges 121 and 131 of side walls 120 and end walls 130 respectively are secured adjacent each other. The side wall edges 121 and end wall edges 131 may include various interlocking geometries and designs. In FIG. 4, the side wall 120 interlocks with the end walls 130 by means of interlocks 143 and 153 respectively. In this example, side walls 120 and end walls 130 have cavities 125 and 135 respectively that are open at a slot along substantially the entire length of the side edge of the side walls and end walls opposite the side edge that connects to the base 115. Extension walls 140 and 150 are adapted to nest within the cavities 125 and 135 respectively in the side walls 120 and end walls 130. The extension walls 140 and 150 telescope into and out of the cavities 125 and 135. The extension walls 140 and 150 may be releasably fixed at variable heights through use of the notches 142 and 152 respectively. Spring latches 126 and 136 are secured to the side walls 120 and end walls 130 respectively. The spring latches 126 and 136 include latches 127 and 137 respectively. Those latches 127 and 137 are received into the notches 142 and 152. The spring latch 126 and notch 142 (with respect to side walls 120) and spring latch 136 and notches 152 (end walls 130) are one example of a lock that may be used to releasably fix the extension walls 140 and 150 at a desirable and adjustable height. Of course, other types of locks may be used including a pin in slot construction (see FIGS. 5-7) or any other type of releasably fixing construction.

Referring now to 3A-3D, the example of the operation of the multi-height, telescoping extension container is described. In FIG. 3A, the container 100 is shown in the mostly collapsed position with only one of the side walls 120 rotated into the upward and upright position. In FIG. 3B, the end walls 130 are rotated upwardly and are latched into place with the side walls 120 into the upright position. In FIG. 3C, one of the side walls 140 is shown in an extended position. The side walls 120 may be locked in place by use of the spring latch 126 as shown with the arrow. In FIG. 3D, all of the extension walls 140 and 150 are shown in the upright, extended position. In each case, the latch 126 or 136 is shown.

While FIGS. 3A-3D and FIG. 4 show a container 100 having a single set of extension walls 140 and 150, it is readily apparent that there may be multiple additional extension walls (not pictured) that telescope in an ever narrowing fashion from the side walls 120 and end walls 130. The construction would be conceptually the same or similar to that shown herein. Other locks could be used to fix multiple extensions in the upright and extended position.

Turn next to FIGS. 5-7, there is shown another example of an adjustable height container 200. This container 200 is described as the multiple-height, slidable extension concept.

The slidable extension container 200 includes a base 210 that is functionally identical to base 20 and base 110 disclosed in connection with the earlier examples. In this example, however, the side walls 220 and end walls 230 are connected to the base in a fixed, non-pivoting fashion. Alternatively, not shown, the side walls 220 and end walls 230 could be pivotably attached as described in the earlier examples. Similarly alternatively, the walls of the earlier containers could be attached to their respective bases in a fixed, nonpivoting fashion. In this example of fixed wall construction, the side edges 225 of the side walls 220 and the adjacent side walls 235 of the end walls 230 are interlocked with each other. This way, extension walls 240 and 250 are slidably engaged with side walls 220 and end walls 230 respectively. As shown in FIGS. 5-7, the extension walls 240 and 250 are slidably engaged on the outside of the side walls 220 and end walls 230. The extension walls 240 and 250 are substantially the same length as the corresponding side walls 220 and end walls 230. A pair of grooves 221 and 231 are the tracks that enable slidable engagement of the extension walls 240 and 250 with the respective side walls 240 and end walls 230. Pin in slot mechanisms 246 on the side wall 220 and 256 on the end walls 230 are the locks that allow the releasable fixation of the extension walls 240 and 250 onto the side walls 220 and 230. An interlock configuration 241 and the side wall extensions 240 and interlock mechanism 251 on the end walls 250 mean that there is no need for a lock on the top or extension portion of the container 200 made of the extension walls 240 and 250. The interlocks 241 and 251 maintain the integrity of the side wall construction.

The interlocks 241 and 251 as well as any interlocking mechanisms noted herein and shown in the drawings may have various geometries as known to those of skill in the art. It is merely noted that the various interlocking constructions are incorporated along the side edges of the adjacent side walls, end walls and extension walls. It is also preferred that whatever interlocking geometries are chosen interact with adjacent wall interlocks to improve the integrity of the container in the assembled condition whether in the regular, upright position, e.g. FIGS. 1B and 3B, or in the extended position, e.g. FIGS. 1D, 3D and 5.

The extension walls 240 and 250 of container 200 are shown as being on the outside of the container, but they could be configured on the inside of the container having a similar and appropriate geometry. Still further, there could be additional extension walls (not shown) that allow for the slidable extension of the container to a still higher height.

FIGS. 6 and 7 demonstrate the containers 200 and 200*a* in a stacking relationship. The feet portion (not shown) of container 200*a* nest inside the extension walls of container 200. FIGS. 6 and 7 merely demonstrate the stackable nature of the containers 200. This similar view could also be taken of the earlier containers 110 described earlier herein.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A collapsible container having adjustable height walls, the container comprising:

a base defining the bottom wall of the container;

an opposing pair of side walls and an opposing pair of end walls, the side walls and end walls comprising first hinges that pivotally connect the side walls and end walls to the base, wherein the side walls and end walls are pivotable between an upright position and a collapsed position over the base;

the side walls and end walls further comprising first latches to releasably engage respective adjacent pairs of side edges of the side walls and end walls when the side walls and end walls are in their upright position; and the side walls and end walls each further comprising extension walls movably connected thereto between a nested, unextended position and an upright, extended position, wherein the extension walls further comprise second latches to releasably engage respective adjacent pairs of side edges of the extension walls when the extension walls are in an upright, extended position;

wherein each of the side walls and end walls comprises a cavity and a slot along substantially the entire length of the side edge of the side walls and end walls opposite the side edge of the side walls and end walls that connect to the base, and the extension walls are adapted to nest within the respective side wall and end wall cavities when in the unextended position and telescope out of the cavities when in the extended position;

whereby the container is collapsible for storage and has extendible side walls and end walls.

2. A collapsible container as described in claim 1, wherein each of the end walls and side walls further comprise a lock for releasably fixing the respective extension walls to each side wall and end wall.

3. A collapsible container as described in claim 2, wherein each lock comprises a plurality of height positions, whereby the extension walls may be releasably fixed at a plurality of heights.

4. A container having adjustable height walls, the container comprising:

a base defining the bottom wall of the container;

an opposing pair of side walls and an opposing pair of end walls;

the side walls and end walls each comprising extension walls movably connected thereto between a nested, unextended position and an upright, extended position, wherein the extension walls further comprise latches to releasably engage respective adjacent pairs of side edges of the extension walls when the extension walls are in an upright, extended position;

wherein each of the side walls and end walls comprises a cavity and a slot along substantially the entire length of the side edge of the side walls and end walls opposite the side edge of the side walls and end walls that connect to the base, and the extension walls are adapted to nest within the respective side wall and end wall cavities when in the unextended position and telescope out of the cavities when in the extended position;

whereby the container has extendible side walls and end walls.

* * * * *